United States Patent [19]

Holmstrom

[11] 4,215,806

[45] Aug. 5, 1980

[54] TENSION BRIDLE

[75] Inventor: James R. Holmstrom, Warren, Ohio

[73] Assignee: Wean United, Inc., Pittsburgh, Pa.

[21] Appl. No.: 879,417

[22] Filed: Feb. 21, 1978

[51] Int. Cl.[2] ..... B65H 23/08

[52] U.S. Cl. ..... 226/195; 226/102

[58] Field of Search ..... 226/91, 93, 94, 95, 226/96, 195, 102, 108, 190; 242/67.3 R, 67.3 F, 78.1, 78.3, 75.2, 147 M, 147 R, 155 R, 155 M; 29/118

[56] References Cited

U.S. PATENT DOCUMENTS

| | | | |
|---|---|---|---|
| 2,519,882 | 8/1950 | Bullard et al. | 242/155 M |
| 2,714,840 | 8/1955 | Bayrer et al. | 226/91 |
| 3,433,398 | 3/1969 | Fadden et al. | 226/195 |
| 3,536,485 | 10/1970 | Roth et al. | 29/118 |

*Primary Examiner*—H. Grant Skaggs
*Attorney, Agent, or Firm*—Daniel Patch

[57] ABSTRACT

The disclosure relates to a multi-roll tension bridle for hot and cold rolled steel strip, in which at least the first roll of the bridle is provided with an internally mounted normally non-rotating electromagnet for causing the strip to be attracted against the entry portion of the roll in order to create a pretensioning in the portion of the strip immediately adjacent the entry side of the bridle, thereby causing the bridle drive motor to load up preventing slippage of strip on the roll.

12 Claims, 4 Drawing Figures

TENSION BRIDLE

The tension bridle as employed in the steel industry, as for example in continuous tension levelling side trimming processing lines, are sometimes placed in the line in a position where the strip coming to the bridle is under little or no externally applied tension. In order for the tension bridle and more specifically the first roll thereof to effectively contribute to the desired total amount of tension producible by the bridle in the passing strip it was customary to provide a device to impose a pre-tension on the strip in the form of either drag boards, drag magnets, or a set of pinch rolls or bending rolls.

The well recognized objection to the drag boards which usually consisted of several wooden boards arranged to engage the upper and lower sides of the passing strip, was the serious surface defects that were created. While the drag pinch roll unit reduced this fault, it was accomplished at the expense of creating serious tracking or guiding conditions for the strip passing through the bridle. The bending rolls tracked the strip and did not cause marking, however, it could not create sufficient tension on light gauge material. The bending rolls also caused work hardening of the material and physical changes in the material. Drag magnets did not create sufficient tension on light gauges. Moreover, because of the ineffectiveness of previous pre-tension means and methods, it was usually required to modify the bridle design and to provide a tension bridle having more than two rolls which was extremely expensive, both from an initial investment standpoint as well as from an operational and maintenance point of view.

Therefore, it is one of the objects of the present invention to provide a means for pretensioning material, which, while not necessarily so limited, has immediate use in a tension bridle for hot and cold rolled carbon steel strip in which pretensioning of the strip is accomplished without danger of marking, wherein strip tracking will be greatly improved and in which the optimum effectiveness can be obtained for the rolls and particularly in the first roll of the bridle obtaining a higher loading resulting in greater strip tensioning thereby so that in certain cases the number of rolls can be reduced, for example, from a four roll tension bridle unit to a two roll unit.

More particularly, the present invention provides a tension bridle unit for processing continuously moving striplike material coming to the unit under little or no externally applied tension, comprising a pair of cooperative tension rolls arranged to partially encircle succeeding portions of the material, said unit including means for rotatably supporting said rolls, and means for mounting internally in at least said one roll arranged to first contact the material, material attracting means capable of causing the material to contact said one roll, thereby to create a tension in the material coming to said unit adjacent said one roll.

Another object of the invention is to provide a tension bridle unit wherein said material attracting means includes a magnetic means and wherein said material is a ferrous based material, such as flat rolled steel.

These objects, as well as other novel features and advantages of the present invention, will be better understood when the following description of a preferred embodiment is read along with the accompanying drawings of which:

Figure 1:
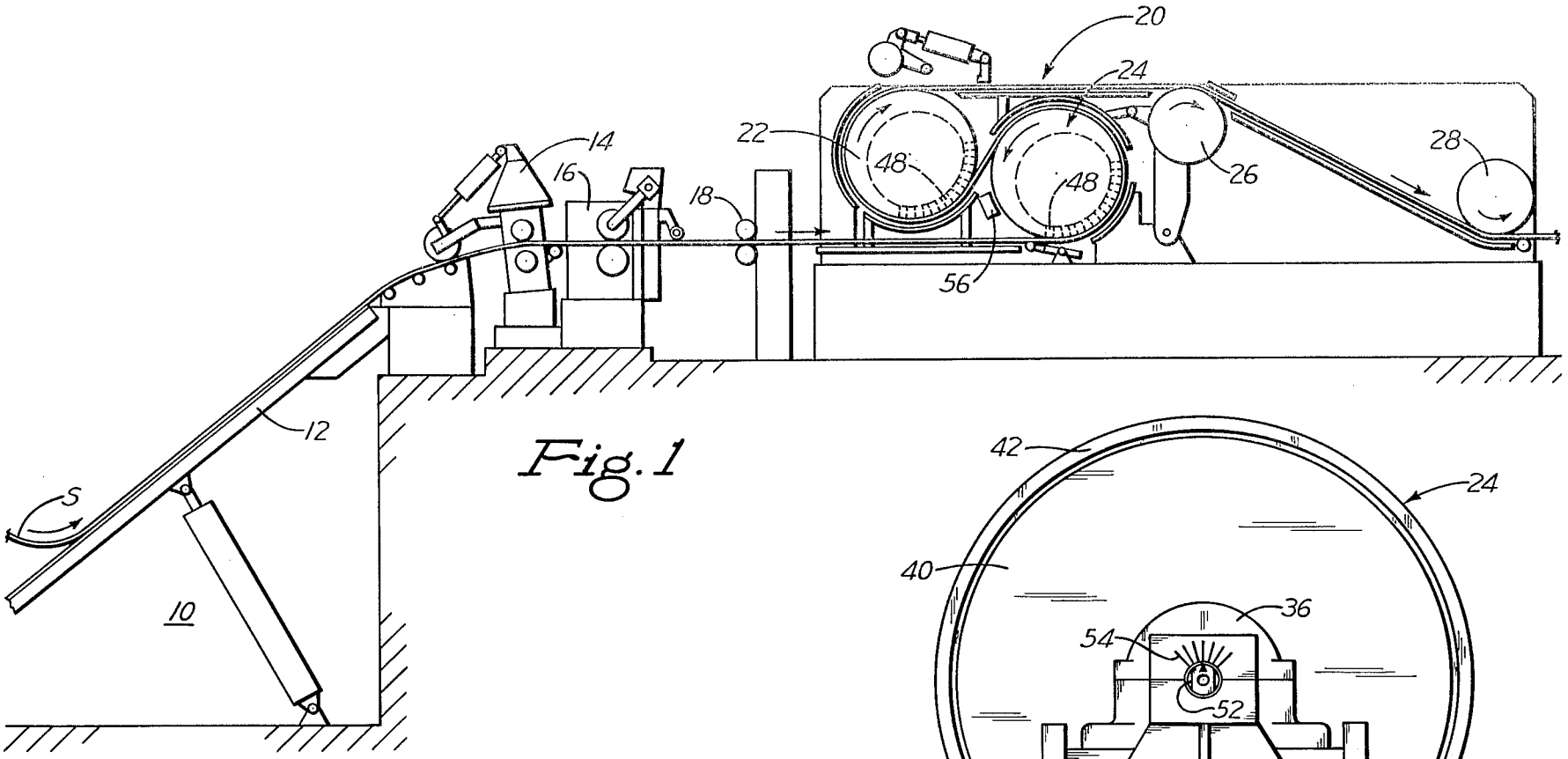
FIG. 1 is a longitudinal schematic view of a portion of a processing line for cold rolled carbon steel strip including a two roll tension bridle constructed in accordance with the teaching of the present invention.

With reference first to FIG. 1, which as indicated, is a portion of a processing line for cold rolled carbon steel strip, the strip S is shown passing from left to right and being drawn out of a gathering pit 10 where it is supported and upwardly guided by an inspection or threading table 12.

At the delivery end of the pit 10, the strip passes into a threading pinch roll unit 14 prior to entering a strip edge side trimming unit 16 from where the trimmed strip is advanced onto a pass line roll unit 18, which as in the case of the pinch roll unit 16, is only employed to feed the leading end of the strip forward and after the end is fed to the succeeding unit the top pinch rolls are raised out of contact with the strip leaving the bottom rolls to support the strip. The strip from the pass line rolls unit 18 issued to a two roll strip tension bridle 20 where it in succession is caused to encircle approximately three fourths of the periphery of two cooperative tension rolls 22 and 24, before it is directed away from the bridle 20 by deflector rolls 26 and 28. The strip then issues from the tension bridle to the delivery end of the line concluding with a shear and tension reel for forming tightly wound coils, neither of which is shown.

The equipment above described, and other elements shown, but not mentioned, are well known in the steel industry as well as the operations of the components including the tension bridle itself. What is not shown in FIG. 1 and which focuses attention on the present invention is one of the four previously employed devices such as the drag boards or a pinch roll unit employed to provide pretension on the strip passing to the bridle 20. Such pretensioning is accomplished instead by the present invention providing an internally strip attracting force within at least the roll 24 of the bridle 20. While this force, depending on the material being processed, and other factors, can take several different forms such as air or magnetic, for the purpose of describing the invention in detail an electromagnetic force has been illustrated.

Figure 2:
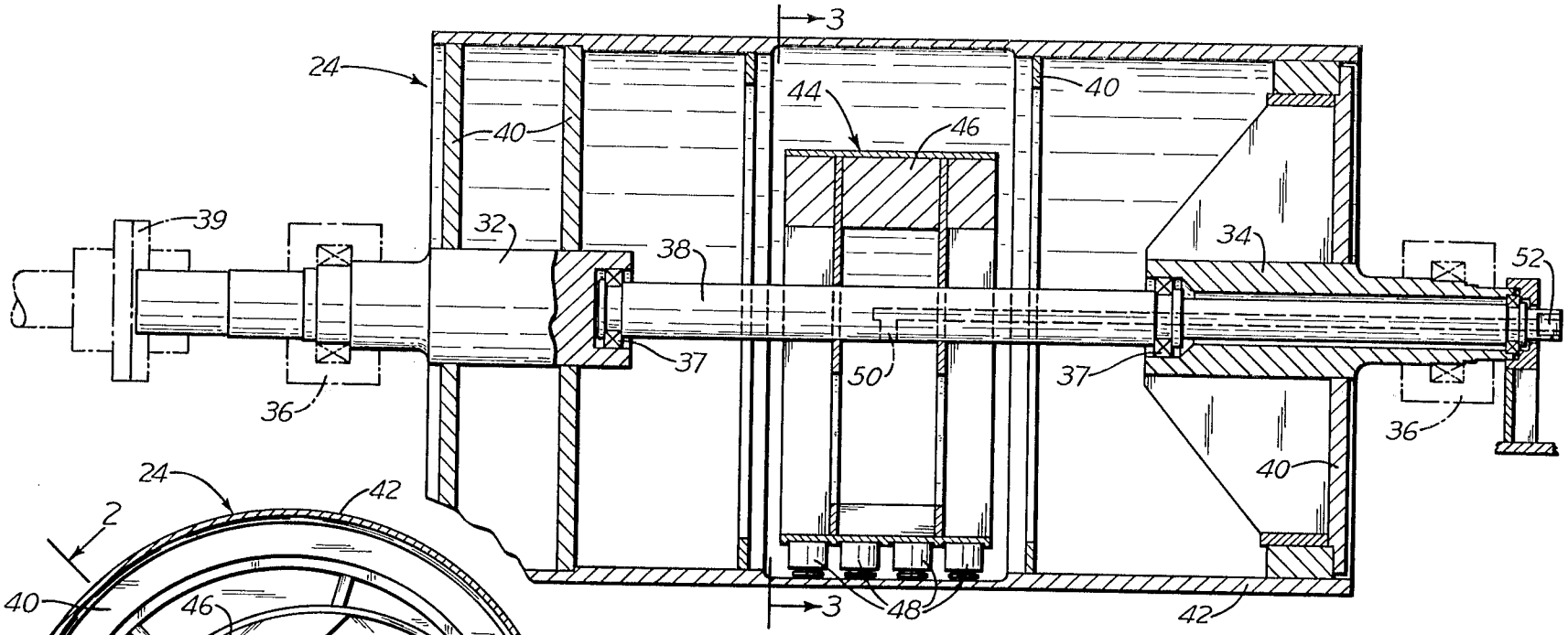
FIG. 2 is a partial axial sectional view taken on lines 2—2 of FIG. 3 illustrating one of the rolls of the tension bridle shown in FIG. 1.
Figure 3:
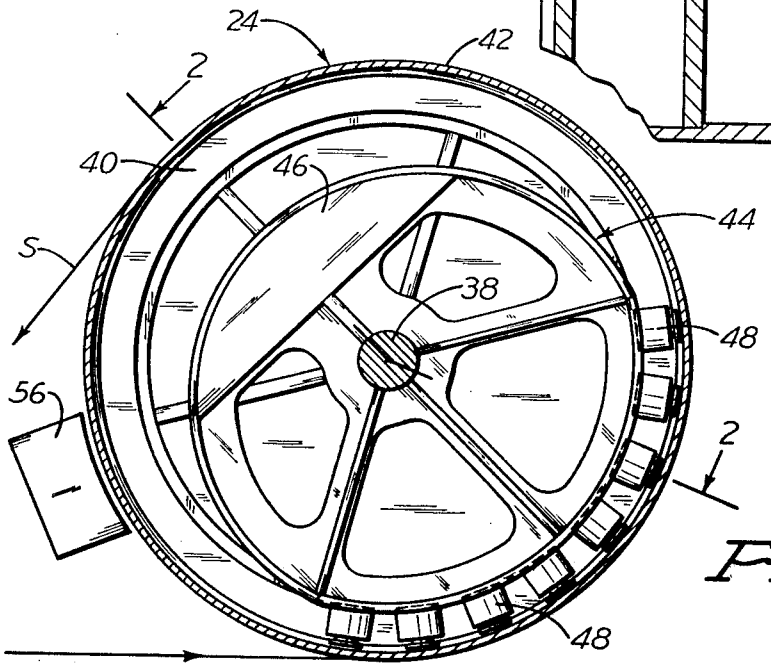
FIG. 3 is a sectional view taken on lines 3—3 of FIG. 2.

While the rolls 22 and 24 are shown in FIG. 1 to have a series of electromagnets, the construction thereof and the roll itself is best shown in FIGS. 2 and 3 where the roll 24 is shown in some detail. In these figures there is shown an opposed pair of rotating shafts 32 and 34, the shafts being supported by bearing stands 36, in which the shaft 32 is connected by a coupling 39 to a drag generator in the usual manner, not shown. The inner ends of both shafts 32 and 34 carry bearings 37 for supporting a centrally located shaft 38. This shaft is normally stationary relative to the shafts 32 and 34. Rigidly secured to the shafts 32 and 34 are a series of radially arranged ribs 40 for supporting an outer steel shell 42 of the bridle roll. For some applications it may be desirable to make the shell out of stainless steel, fiberglass or plastic and cover it with rubber or other material to reduce strip marking, and/or relieve the distortion of the magnetic field.

Figure 4:
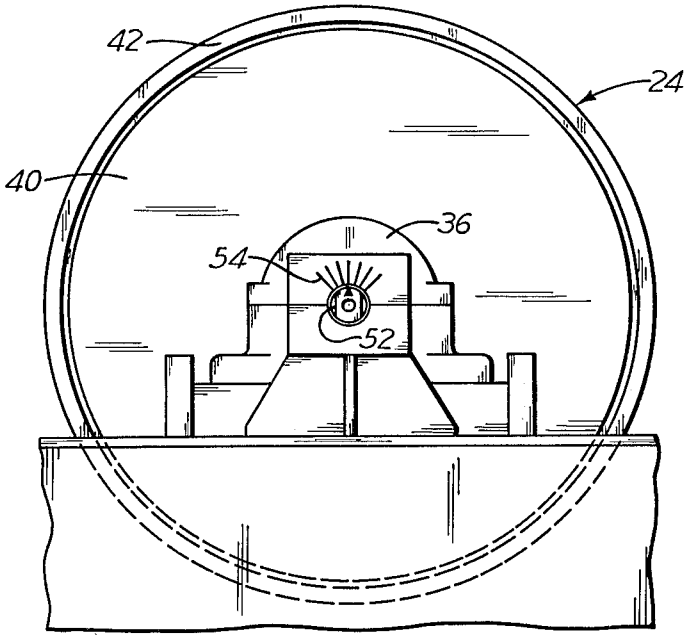
FIG. 4 is an end view of one of the rolls shown in FIGS. 2 and 3.

In the construction shown, the roll is driven from the shaft 32 through the ribs 40 associated therewith to the other end of the shell 42 and its ribs to the freely rotatable shaft 34. The normally non-rotatable shaft 38 at its center supports a frame 44 rigidly connected thereto having at its upper end as one views FIG. 2, a counterweight 46 and at its lower end four similar rows of electromagnets 48. The magnets are arranged to just clear the inside adjacent surface of the shell 42. The necessary electrical outlet for the electromagnets 48 is provided by a passageway 50 in the right hand side of the shaft 38. The end of the shaft also is provided with a squared portion 52, best shown in FIG. 4, for allowing the shaft 38 and the frame 44 to be rotated so that the position of the magnets 48 can be adjusted relative to the point at which the strip first contacts the roll 24, which adjustment features can be best appreciated by looking at FIG. 3. Should, in a given case, it be desirable to delay or advance the magnetic attraction of the strip against the shell 42, the magnetic field can be adjusted as desired and after which the shaft 38 can be locked in the adjusted position by a locking device such as a shaft encircling bolted clamp. The actual radial position of the electromagnets as one views FIG. 3 is indicated by a gauge 54, shown in FIG. 4. Upon unlocking the shaft the counterweight 46 will reposition the magnets so that the rows of magnets will fall in the second and third quadrants of the roll 24.

In applying the present invention to pretension steel strip there may be a tendency of ferrous particles to inadvertently adhere to the shell 42 causing marking of the underside of the strip as it engages the shell. To automatically remove such particles before this can happen there is provided a well known cleaning magnet 56. It will be appreciated that the magnet 56, as well as magnets 48 can be either permanent or electric. In the latter case, particularly, as to the magnets 48, the advantage of employing electromagnets is found in the fact that by employing a rheostat or voltage control unit the strength of the field can be easily and accurately controlled from "0" to full power to accommodate various opertional conditions.

While the invention has been described with the frame 46 for the electromagnets normally stationary and the shell rotatable about it, if desired the two elements can be made to rotate together and the energization of the magnets controlled by a commutator, in phase with the particular portion of the entire circumferential area of contact where it is desired to attract the strip against the shell to create the pretension condition desired. Also, instead of a magnetic force the use of a vacuum or air draft method can be employed for certain applications. In this case holes will be located in the roll with inside baffles to limit the exposure to the desired quadrant of the roll, such as the first quadrant in terms of where the strip first engages the roll. Also, while the invention has been illustrated and described in conjunction with a shearing and levelling processing line for the steel industry, it can be used for hot and cold rolled steel strip processing lines as well as for other materials and industries.

While in FIG. 1 both rolls 22 and 24 are shown with electromagnets, in many applications only roll 22 may require magnetization. One important aspect of the present invention that contributes to improved strip tracking in the processing of cold rolled steel strip is the location of magnets in the axial center of the roll as one views FIG. 2 so that the magnetic axial field of force covers approximately the central fourth of the total axial length of the shell 42. While the extent of the location of the central field may vary, for such relatively stiff material as carbon steel cold rolled strip at relatively high processing speeds, the arrangement illustrated is highly desirable.

In operation, after the strip S is fed through the line in the normal manner at a threading speed and processing of the strip is commenced, with the increase of the line speed to its operational speed, the electromagnets can be energized to pretension the strip issuing to the tension bridle 20, in which the aforesaid rheostat or voltage control unit can be varied as a function of line speed or preset as desired to give the desired total strip tension. The pretensioning provided by the electromagnets 48 allows the bridle 20 to operate at optimum efficiency with improved strip tracking and the absence of marking caused by the pretensioning device.

In accordance with the provisions of the patent statutes, I have explained the principle and operation of my invention and have illustrated and described what I consider to represent the best embodiment thereof.

I claim:

1. An improved strip bridle unit having means for optimizing the multiplication of tensioning on the strip of material and employed for processing continuously moving material coming to the unit under little or no externally applied tension, comprising:

a first rotatable roll, a second rotatable roll parallel to the first roll, means for rotatably supporting said first and said second rolls, said rolls each having surfaces arranged in a manner so that succeeding portions of said material partially encircles said surfaces and wherein the strip first encircles said surface of said first roll, said first roll operatively connected to a load developing means, and material attracting means carried by at least said first roll for causing said material to continuously contact said surface of said first roll under a constant force along the width of said strip to create a tension in said material immediately prior to contacting said fist roll to cause said first roll to place an increased load on said load developing means, said material attracting means constructed and arranged in a manner to vary the influence of said material attracting forces relative to the point where said material first contacts said first roll by changing the positioning of said material attracting means carried by said first roll thereby varying the tensioning on said strip.

2. A tension bridle unit according to claim 1 further comprising:

a cleaning device arranged adjacent to a portion of said surface of said first roll not encircled by said material for removing foreign matter from said first roll.

3. A tension bridle unit according to claim 1, further comprising a second material attracting means for said second roll of said unit, means for mounting said second material attracting means internally in said second roll in a manner to cause said material passing to said surface of said second roll from said first roll to adhere to the portion of said second roll with which the material first comes into contact, thereby creating tension in the material coming to said second roll.

4. A tension bridle unit according to claim 1 further including means for internally mounting said material attracting means, and wherein said material attracting means includes a magnetic means and wherein said material is a ferrous base material, said means for internally mounting includes rotatable means for locating said magnetic means in the region where said material first contacts said first roll and in a manner that said attracting forces are located inward of the longitudinal edges of said first roll.

5. A tension bridle unit according to claim 4 wherein said magnetic means includes a series of electromagnets arranged in parallel rows located approximately in the central portion of the longitudinal dimension of said shell.

6. In a tension bridle unit according to claim 4 further includes:

a magnetic cleaning device arranged adjacent to a portion of said surface of said first roll not encircled by said material for removing foreign matter from said first roll.

7. A tension bridle according to claim 4 wherein said surface of said first roll is part of an outer rotating shell, and wherein said means for rotatably supporting at least said first roll comprises two rotatable shaft portions associated with different opposite ends of said first roll for supporting said shell, and wherein said rotatable means for locating said magnetic means carried by said two rotatable shaft portions is constructed and arranged in a manner to move said magnetic means relative to said rotatable shaft portions and said shell thereby causing said varying of said influence of said material attracting forces.

8. A tension bridle according to claim 7 wherein said rotatable means includes a counterweight arranged to urge said rotatable magnetic means to return to a predetermined reference point, and means for indicating the radial position of said magnetic means relative to the rotation axis of said first roll.

9. A tension bridle roll around which strip-like material is encircled comprising:

an outer rotating shell having a surface contacted by said material, two rotatable shaft portions associated with different opposite ends of said roll for supporting said shell, material attracting means internally mounted for causing said material to contact said surface, means located between said rotatable shaft portions for internally mounting said material attracting means, said mounting means including rotatable means constructed and arranged in a manner to rotate relative to said shaft portions and said shell, and means for rotating said rotatable means to vary the influence of said material attracting means around said shell of said roll.

10. A tension bridle roll according to claim 9 wherein said material attracting means includes magnetic means, and wherein said mounting means includes means for locating said magnetic means in the general region where said material first contacts said roll and in a manner that said magnetic forces are located inward and adjacent to said surface of said shell.

11. A tension roll according to claim 10 wherein said magnetic means includes a series of electromagnets arranged in parallel rows located approximately in the middle of said roll.

12. A tension roll according to claim 11 wherein said rotatable means includes a counterweight arranged to urge said magnetic means to return to a predetermined reference point, and means for indicating the radial position of said magnetic means relative to the rotation axis of said roll.

* * * * *